US007766983B2

(12) United States Patent
Schaeffer et al.

(10) Patent No.: US 7,766,983 B2
(45) Date of Patent: Aug. 3, 2010

(54) NANOSTRUCTURED CORROSION INHIBITORS AND METHODS OF USE

(75) Inventors: Jon Conrad Schaeffer, Simpsonville, SC (US); Vinod Kumar Pareek, Albany, NY (US)

(73) Assignee: General Electric Company, Schenectady, NY (US)

( * ) Notice: Subject to any disclaimer, the term of this patent is extended or adjusted under 35 U.S.C. 154(b) by 602 days.

(21) Appl. No.: 11/714,964

(22) Filed: Mar. 7, 2007

(65) Prior Publication Data

US 2008/0216395 A1 Sep. 11, 2008

(51) Int. Cl.
*C10L 1/12* (2006.01)
*C10L 10/04* (2006.01)
*C04B 35/58* (2006.01)

(52) U.S. Cl. ..... 44/357; 977/77; 501/93

(58) Field of Classification Search ..... 44/343, 44/530, 280, 301, 302, 400, 605–606, 500–504, 44/357; 423/592.1; 977/773–777; 501/87–93
See application file for complete search history.

(56) References Cited

U.S. PATENT DOCUMENTS 2,949,008 A 8/1960 Rocchini et al. ..... 60/35.6
3,540,866 A * 11/1970 Miller ..... 44/301
4,047,875 A 9/1977 May et al. ..... 431/3
5,561,977 A 10/1996 Harada et al. ..... 60/39.02
5,593,781 A * 1/1997 Nass et al. ..... 428/403
RE36,117 E 3/1999 Bornstein et al. ..... 44/364
6,632,257 B1 10/2003 Feitelberg et al. ..... 44/370
6,887,302 B2 5/2005 Rajagopalan et al. ..... 95/116
6,933,046 B1 * 8/2005 Cook ..... 428/402
6,984,369 B1 * 1/2006 Alivisatos et al. ..... 423/592.1
2003/0226312 A1 * 12/2003 Roos et al. ..... 44/280
2004/0101976 A1 * 5/2004 Peng et al. ..... 436/525
2005/0004293 A1 * 1/2005 Peng et al. ..... 524/439
2005/0191492 A1 * 9/2005 Yadav ..... 428/407
2005/0260122 A1 * 11/2005 Li et al. ..... 423/594.14

FOREIGN PATENT DOCUMENTS

WO WO 2005060610 A2 * 7/2005

OTHER PUBLICATIONS

Liquid Minerals Group Inc., [online]; [retrieved on Oct. 30, 2009]; retrieved from the Internet http://www.liquidminerals.com/advantage.htm.

* cited by examiner

*Primary Examiner*—Glenn A Caldarola
*Assistant Examiner*—Pamela Weiss
(74) *Attorney, Agent, or Firm*—Cantor Colburn LLP

(57) ABSTRACT

A corrosion inhibitor composition for a fuel, comprising a plurality of nanoparticles formed of an inorganic composition having an average longest dimension of 1 nanometer to 100 nanometers, wherein the inorganic active composition is insoluble in the fuel and is adapted to react with a corrosion causing contaminant.

15 Claims, 2 Drawing Sheets

NANOSTRUCTURED CORROSION INHIBITORS AND METHODS OF USE

BACKGROUND OF THE INVENTION

The present disclosure relates to fuel compositions, and more particularly to corrosion inhibitors for fuel compositions.

When combusted in a turbine, various inorganic contaminants in a fuel can affect turbine operation, particularly over extended periods of time. Certain contaminants in the fuel (e.g., sodium-, potassium-, lead-, mercury-, and vanadium-containing compositions) can cause corrosion of the various parts of the turbine. Although several corrosion mechanisms can occur, one frequently observed manifestation is the surface oxidation and/or pitting of the various turbine parts caused by low melting point (i.e., having a melting point lower than the operating temperatures to which they are exposed) ash deposits originating from these contaminants in the fuel. One approach to mitigate this so-called "hot corrosion" is to add a corrosion inhibitor to the fuel.

Corrosion inhibitors generally function by reacting with a specific contaminant to produce a more benign species, such as a higher melting point non-corrosive ash deposit. Unfortunately, over extended periods of operation, these and other deposits can build up and partially block the flow of cooling air as well as the hot gas through the turbine. Once a threshold level of blockage has been attained, the deposits must be removed by a cleaning procedure, which in some instances necessitates the shut down of the turbine.

There is a need for improved corrosion inhibitors, especially since the increased demand for energy has resulted in a greater number of situations where alternative sources of fuel or fuel with already higher than desired concentrations of contaminants are used. With these so-called "low-grade" fuels, an increase in the dosage of the corrosion inhibitors, while serving to reduce the potential for hot corrosion, will also result in increased build up of deposits and thus more frequent shut down of the turbine for cleaning. Therefore, it would be particularly advantageous if these improved corrosion inhibitors were more efficient than existing corrosion inhibitors.

BRIEF DESCRIPTION OF THE INVENTION

Disclosed herein are corrosion inhibitors and methods of their use. In one embodiment, a corrosion inhibitor composition for a fuel, includes a plurality of nanoparticles formed of an inorganic composition having an average longest dimension of 1 nanometer to 100 nanometers, wherein the inorganic active composition is insoluble in the fuel and is adapted to react with a corrosion causing contaminant.

A method for inhibiting corrosion in a combustion engine, includes adding a corrosion inhibitor composition to a fuel, wherein the corrosion inhibitor composition comprises a plurality of nanoparticles formed of an inorganic composition having an average longest dimension of about 1 nanometer to about 100 nanometers, wherein the inorganic composition is insoluble in the fuel, contacting the corrosion inhibitor composition with a corrosion causing contaminant in the fuel, and reducing a concentration of the corrosion causing contaminant.

The above described and other features are exemplified by the following figures and detailed description.

BRIEF DESCRIPTION OF THE DRAWINGS

Referring now to the Figures, which are exemplary embodiments and wherein like elements are numbered alike.

DETAILED DESCRIPTION OF THE INVENTION

Corrosion inhibitors and methods for their use are described herein. In contrast to the prior art, the disclosed corrosion inhibitors comprise inorganic nanoparticles. "Nanoparticles", as used herein, refers to particles having an average longest dimension of about 1 nanometer (nm) to about 100 nm. Owing to the smaller particle size of the corrosion inhibitor, there is a greater amount of reactive surface area available per unit weight, which allows for more efficient use and improved performance of the corrosion inhibitor in combustion engine (e.g., turbine engines, jet engines, boilers, and the like) applications.

Also, as used herein, the terms "first", "second", and the like do not denote any order or importance, but rather are used to distinguish one element from another, and the terms "the", "a", and "an" do not denote a limitation of quantity, but rather denote the presence of at least one of the referenced item. The modifier "about" used in connection with a quantity is inclusive of the stated value and has the meaning dictated by the context (e.g., includes the degree of error associated with measurement of the particular quantity). Furthermore, all ranges disclosed herein are inclusive of the endpoints and independently combinable.

Figure 1:
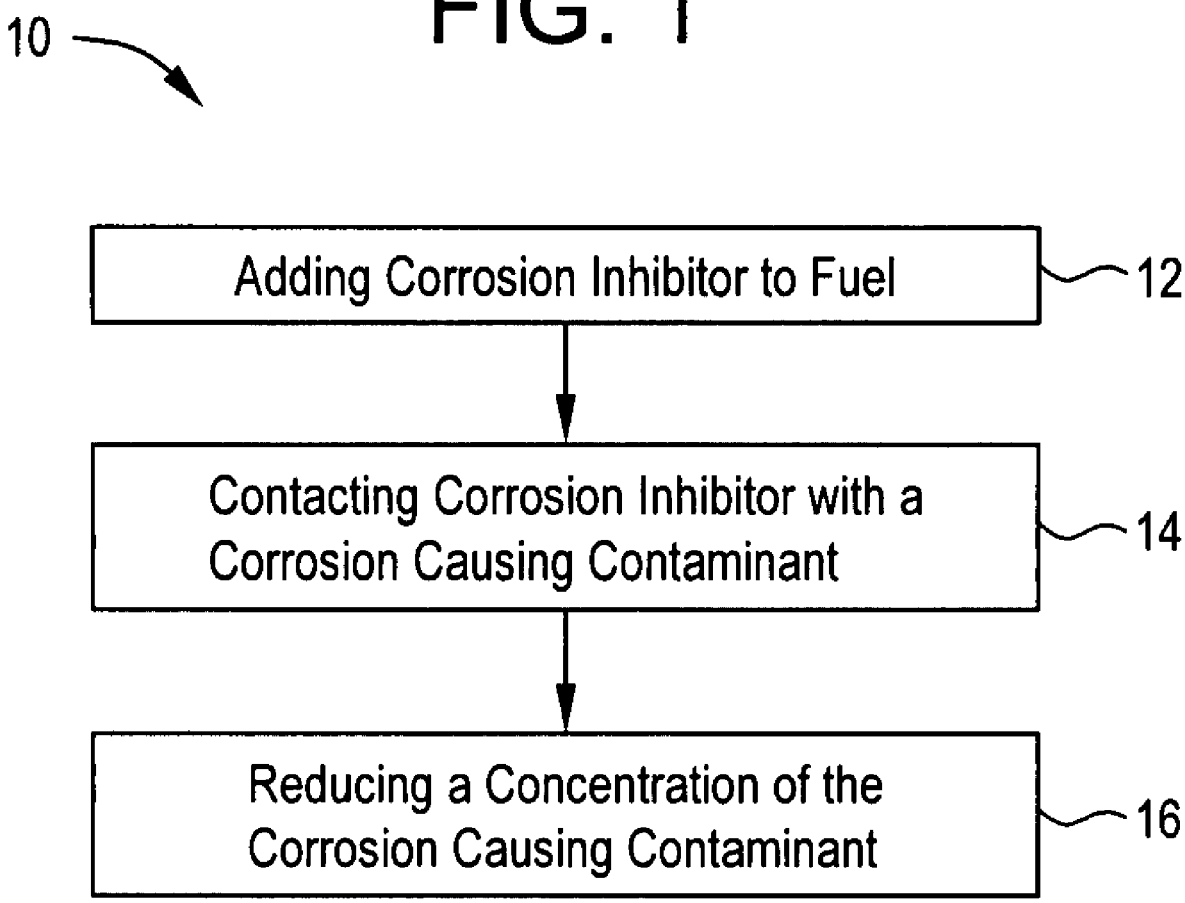
FIG. 1 is a process flow chart for reducing a concentration of a corrosion causing contaminant in a fuel.

Referring now to FIG. 1, an exemplary process flow is shown and generally designated by reference numeral 10. The process 10 generally includes adding the corrosion inhibitor to a fuel 12; contacting the corrosion inhibitor with a corrosion causing contaminant in the fuel 14; and reducing a concentration of the corrosion causing contaminant 16.

Figure 2:
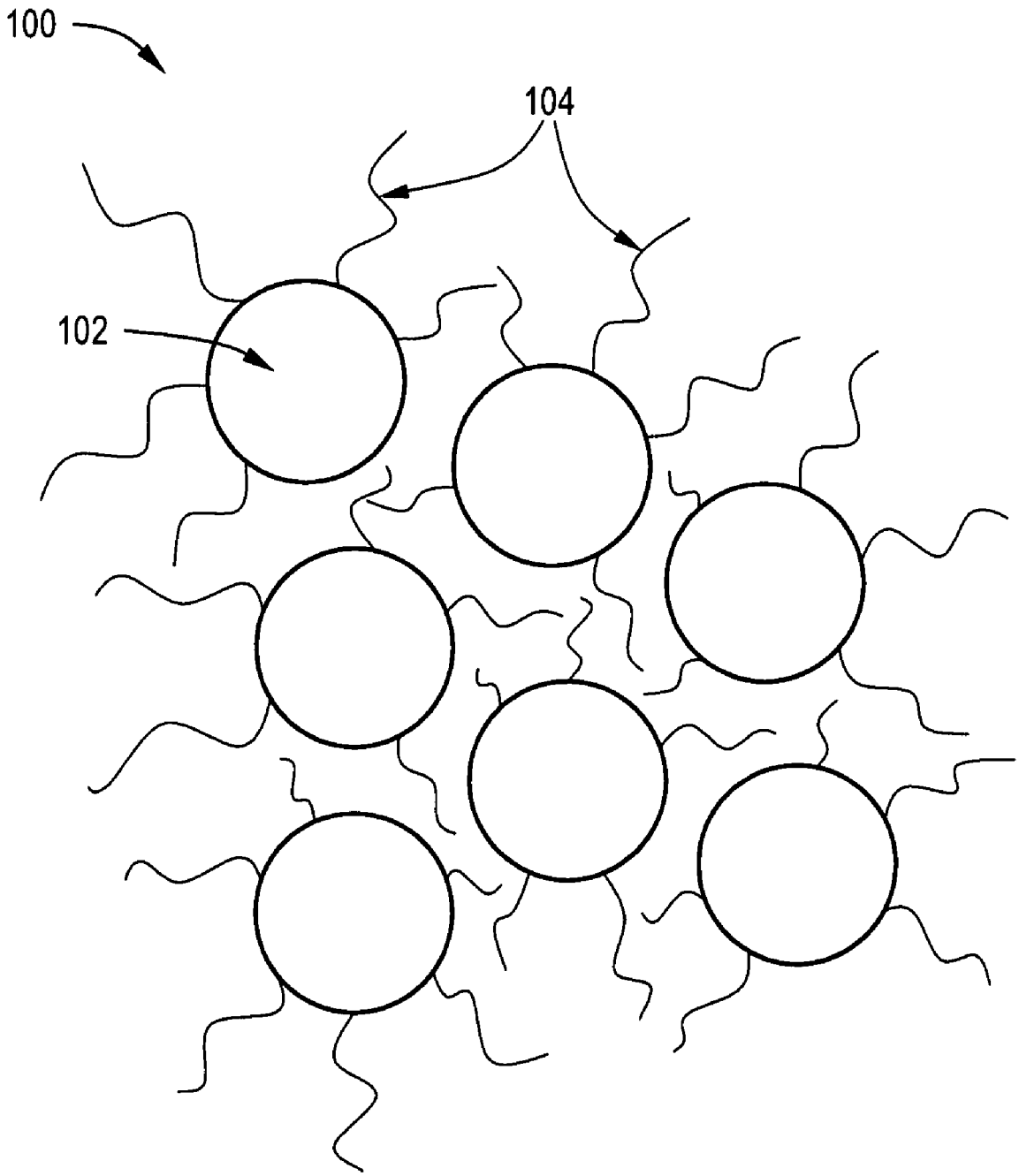
FIG. 2 is a schematic illustration of a cross section of a corrosion inhibitor.

The corrosion inhibitor, which is shown in FIG. 2 and generally designated by reference numeral 100, comprises a (i.e., at least one) nanoparticle formed of an inorganic composition 102 that is selected to react with a corrosion causing contaminant in a fuel so as to produce a non-corrosive species. The corrosion inhibitor 100 may be added to the fuel as a powder or as a mixture. In embodiments where the corrosion inhibitor 100 is added to the fuel as a mixture, the plurality of nanoparticles formed of an inorganic composition 102 is disposed in a carrier fluid such that a dispersion, emulsion, or the like, is formed. The carrier fluid may be water, an alcohol, a polyol, oil, another organic medium, or a sample of the fuel to which the corrosion inhibitor will be added. In addition, the nanoparticles of the inorganic composition can be surface treated to prevent agglomeration of the nanoparticles. For example, the nanoparticles can have capping ligands or surfactants 104 bound to the surfaces of nanoparticles in order to prevent aggregation and/or growth of the nanoparticles. Furthermore, if the plurality of inorganic nanoparticles 102 are pyrophoric, then the corrosion inhibitor 100 must be surface treated and/or added to the fuel as a mixture.

The plurality of inorganic nanoparticles 102 can comprise any inorganic composition that will react with the corrosion causing contaminant to produce a non-corrosive species while not adversely affecting the fuel to which they will be added (e.g., such as by combusting or decomposing the fuel). Fuels suitable for corrosion inhibitor treatment can comprise any suitable gas or liquid, such as for example, natural gas, methane, naphtha, butane, propane, diesel, kerosene, an aviation fuel, a coal-derived fuel, a bio-fuel, an oxygenated hydrocarbon feedstock, and mixtures comprising one or more of the foregoing fuels. Specific corrosion causing contaminants include compositions that contain sodium (Na), potassium (K), lead (Pb), vanadium (V), zinc (Zn), mercury (Hg), or a combination comprising at least one of the foregoing elements. Furthermore, the nanoparticles formed of the inorganic composition 102 must be insoluble in the fuel to which they will be added throughout all temperatures during which the fuel remains a liquid. Advantageously, by avoiding the use of fuel- or oil-soluble corrosion inhibiting compositions (e.g., metal carboxylates, metal sulfonates, metal phosphates, and the like), which have low decomposition temperatures, higher combustion temperatures can be achieved. With higher combustion temperatures comes greater turbine efficiency.

Specific insoluble inorganic compositions that can be used for the plurality of nanoparticles 102 may be chosen from a metal oxide, a metal carbide, a metal nitride, a metal carbonitride, a metal boride, a metal oxycarbide, a metal oxynitride, a metal silicide, or the like, or a combination comprising at least one of the foregoing. Specific metals for use in the nanostructured inorganic composition include aluminum (Al), iron (Fe), calcium (Ca), nickel (Ni), chromium (Cr), silicon (Si), manganese (Mn), zirconium (Zr), cerium (Ce), Yttrium (Y), magnesium (Mg), cobalt (Co), hafnium (Hf), titanium (Ti), or the like, or a combination comprising at least one of the foregoing.

The exact composition(s) used for the nanoparticle inorganic composition 102 will depend on the particular corrosion causing contaminants and their concentration within the fuel to be treated, and can be readily determined by those skilled in the art in view of this disclosure. For example, many nanostructured metal-containing compounds can be used to control vanadic corrosion by reacting with ash deposits of vanadium pentoxide ($V_2O_5$), which melts at about 675 degrees Celsius (° C.), to produce the metal orthovanadate, which (depending on the particular metal) melts at greater than or equal to about 1000° C. Exemplary nanostructured metal-containing compounds useful for controlling vanadic corrosion include magnesium oxide (MgO), oxides of nickel ($NiO_x$, wherein x is about 0.9 to about 1.6), gadolinium oxide ($Gd_2O_3$), yttrium oxide ($Y_2O_3$), and the like. In addition, nanostructured chromium-containing compounds can be used to inhibit sulfidation corrosion promoted by alkali metal (e.g., sodium and potassium) contaminants interacting with sulfur within the fuel. Exemplary nanostructured chromium-containing compounds include chromium carbide ($Cr_3C_2$), chromium oxide ($Cr_2O_3$), chromium oxycarbide ($Cr_2CO$), and the like. Still further, nanostructured silicon-containing compounds can be used to inhibit corrosion by promoting friability of ash deposits. Exemplary nanostructured silicon-containing compounds include silicon carbide (SiC), silicon nitride ($Si_3N_4$), silicon oxynitride ($Si_2N_2O$), and the like. Once again, since some of these compositions, such as MgO, are not stable in air, the nanoparticles 102 may be surface treated with the capping ligand 104 and/or added to the fuel as a mixture.

The amount of the corrosion inhibitor 100 present in the fuel is that which is effective to reduce corrosion within the fuel and/or the engine in which the fuel is consumed. An advantageous feature of using the corrosion inhibitors 100 described herein is that a lower concentration of the nanoparticulate inorganic composition-containing corrosion inhibitor 100 can be used to achieve at least the same, if not better, results than a corrosion inhibitor comprising larger scale particles. Alternatively, at least the same, if not better, corrosion reduction can be achieved when the same (or lower) concentration of a nanoparticle inorganic composition-containing corrosion inhibitor 100 is added to a low-grade fuel as a corrosion inhibitor comprising larger scale particles when added to a higher-grade fuel.

Without being bound by theory, these benefits are at least in part due to nanostructured materials having a significantly higher surface to (bulk) volume ratio than micrometer or larger-scaled particles. By way of illustration, a particle having a diameter of 10 micrometers will have less than 1% of the total number of atoms on its surface. In contrast, a particle having a diameter of about 10 nm will have about 20% of the total number of atoms on the surface. Still further, a particle having a diameter of about 2 nm will have about 80% of the total number of atoms on the surface. Owing to the higher surface to volume ratio, reactivity is significantly increased as particle size is decreased.

Therefore, the specific amount of the corrosion inhibitor 100 to be dispersed in the fuel will depend in part upon the size of the nanoparticles in the inorganic composition 102, the concentration of the corrosion causing contaminant within the fuel, and the level of corrosion inhibition desired, and can readily be determined by one of ordinary skill in the art in view of this disclosure. Generally, the nanoparticulate inorganic composition 102 in the corrosion inhibitor 100 is present in the fuel at a concentration of about 1 parts per million (ppm) to about 5000 ppm. One part per million can also be represented as 1 milligram (mg) of the nanoparticulate inorganic composition 102 of the corrosion inhibitor 100 per liter (L) of fuel.

The nanoparticles formed of the inorganic composition 102 of the corrosion inhibitor 100 may be formed by a variety of techniques including sol-gel processing, gas phase synthesis (e.g., inert gas condensation, combustion flame synthesis, laser ablation, chemical vapor condensation, electrospray, plasma spray, or the like), sonochemical processing, hydrodynamic cavitation, microemulsion processing, high-energy mechanical attrition (e.g., room temperature ball milling, cryomilling, or the like), or like technique. These techniques are known, and the choice of technique to produce a specific plurality of nanoparticles formed of an inorganic composition will be recognizable to those skilled in the art in view of this disclosure.

The nanoparticles can be produced to have a specific size. For example, in one embodiment, the average longest dimension of the nanoparticles of the inorganic composition 102 is less than about 50 nm. In another embodiment, the average longest dimension of the nanoparticles of the inorganic composition 102 is less than about 25 nm. In another embodiment, the average longest dimension of the nanoparticles of the inorganic composition 102 is less than about 10 nm. In still another embodiment, the average longest dimension of the nanoparticles of the inorganic composition 102 is less than about 5 nm. As described above, the reactivity of the inorganic composition 102 can be significantly increased as particle size is decreased. Thus, a corrosion inhibitor 100 with nanoparticles having an average longest dimension of less than about 25 nm may be more desirable than one with nanoparticles having an average longest dimension of less than about 50 nm from a reactivity standpoint. In turn, a corrosion inhibitor 100 with nanoparticles having an average longest dimension of less than about 10 nm may be more desirable than one with nanoparticles having an average longest dimension of less than about 25 nm. Similarly, a corrosion inhibitor

100 with nanoparticles having an average longest dimension of less than about 5 nm may be more desirable than one with nanoparticles having an average longest dimension of less than about 10 nm.

Since nanoparticles have a tendency to agglomerate owing to their thermodynamically unstable surfaces, particularly as their size is reduced, the nanoparticles can have capping ligands or surfactants 104 bound to the surfaces of nanoparticles in order to prevent aggregation and/or growth of the nanoparticles. Such ligands 104 include a binding group, which interacts with the surface of a nanoparticle, and a tail group or moiety that interacts with the carrier fluid and/or the fuel. The tail group can be hydrophobic or hydrophilic depending on whether the corrosion inhibitor 100 is intended to react with a corrosion causing contaminant in the organic part of the fuel or the aqueous part of the fuel (e.g., water that has accumulated at the bottom of a fuel tank), respectively. While the capping ligand 104 can prevent or minimize agglomeration of the nanoparticles of the inorganic composition 102, the capping ligand should not render the nanoparticles soluble in the fuel.

Capping ligands include compounds having the general formula $(R)_n$—X, where X is an atom or functional group capable of binding to the surface of the nanoparticles. The term "binding" refers to an interaction that associates the capping ligand with the nanoparticles. Such interactions may include ionic, covalent, dipolar, dative, quadrupolar or van der Walls interactions. Each R group is independently hydrogen, an aryl group having between 1 and 20 carbon atoms or an alkyl group having between 1 and 20 carbon atoms. X may be an atom that includes, but is not limited to, nitrogen, carbon, oxygen, sulfur, and phosphorus. Alternatively, X may be a functional group that includes, but is not limited to, a carboxylate, a sulfonate, an amide, an alkene, an amine, an alcohol, a hydroxyl, a thioether, a phosphate, an alkyne, an ether, or a quaternary ammonium group. Exemplary capping ligands include thiols, alkanethiols, alkyl amines, alkoxylated amines, mercaptoalkyl amines, phosphates, alkyl ether phosphates, alcohols, alkoxylated alcohols, mercaptoalcohols, modified linear aliphatic polymers, alkyl silanes, mercaptoalkyl silanes, alkylphosphine oxides, and the like.

Nanoparticles may be prepared by using methods known to those skilled in the art. The capping ligands 104 can be added to nanoparticles through formation of the nanoparticles by reacting a metallic precursor in the presence of a capping agent. Heating of the precursor results in the thermal degradation of the precursor, which in turn leads to the formation of nanoparticles. The precursor may degrade through a free radical mechanism, or it may degrade through thermolysis. The dimensions of the nanoparticles can then be controlled by reaction conditions and the capping ligand used. The reaction conditions used to control the particle size may include, for example, the temperature, pressure, precursor concentration, capping ligand concentration, solvent, precursor composition and capping ligand composition. It should be appreciated that the methods and compositions described can be modified to accommodate the construction of nanoparticles from a variety of thermally degradable precursors by modifying the reaction vessel, addition of a solvent, altering the capping ligand, and/or reagents, or through the sequential addition of reactants after initial particle nucleation.

The capping ligand interacts with the precursor during formation of the nanoparticle to assist in controlling the growth of the particle. The capping ligand can bond covalently to the particle surface, or stick through weak interactions, such as hydrogen bonding. The capping ligand can also physisorb to the particle surface. In one embodiment, capping of the particle surfaces may occur through a combination of organic ligands and inorganic small molecules. Additionally, the capping ligand may assist in solubilizing the precursor. Additionally, two or more kinds of capping ligands might be added to the reaction mixture. In one embodiment, a mixture of precursors may be added to the reactor for nanoparticle formation.

The corrosion inhibitor 100 can further comprise other components which can have various desirable effects when mixed with the nanoparticulate inorganic composition 102. For example, the mixture may comprise stabilizers, pH regulators, viscosity modifiers, wetting agents, and/or other chemical agents that may promote wetting of the substrate and/or inhibit settling of the coating composition within the mixture.

Once the corrosion inhibitor has been formed, it may be added to the fuel. The corrosion inhibitor is generally added to the fuel prior to combustion of the fuel while the fuel is being stored. Upon interaction, the nanostructured inorganic composition of the corrosion inhibitor will chemically react with the low-melting corrosion causing contaminants prior to combustion or on a surface of an engine component downstream of fuel combustion to produce a non-corrosive species with a melting point sufficiently higher than that of the corrosion causing contaminant.

While reference has primarily been made to turbine applications, it should be recognized that the nanostructured corrosion inhibitors disclosed herein are suitable for use in any application in which a fuel is combusted and in which hot corrosion occurs. For example, the nanostructured corrosion inhibitors disclosed herein can be used in boilers, locomotives, process heaters, incinerators, oil field steam generators, stationary generators, and the like.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A corrosion inhibitor composition for a fuel, comprising:

a plurality of nanoparticles formed of an inorganic active composition having an average longest dimension of about 1 nanometer to about 100 nanometers and comprising a metal boride, a metal oxycarbide, a metal silicide, or a combination comprising at least one of the foregoing;

a at least one capping ligand bound to at least one nanoparticle;

a fuel, wherein the inorganic composition is present in the fuel at a concentration of about 1 part per million to about 5000 parts per million; and wherein the inorganic active composition is insoluble in the fuel and will react with a corrosion causing contaminant in the fuel to produce a non-corrosive species with a melting temperature greater than that of the corrosion causing contaminant.

2. The corrosion inhibitor composition of claim 1, wherein the at least one capping ligand comprises a binding group and a tail group.

3. The corrosion inhibitor composition of claim 1, wherein the tail group is hydrophobic.

4. The corrosion inhibitor composition of claim 1, wherein the tail group is hydrophilic.

5. The corrosion inhibitor composition of claim 1, wherein the at least one capping ligand is a surfactant.

6. The corrosion inhibitor composition of claim 1, wherein the metal of the inorganic composition comprises aluminum, iron, calcium, nickel, chromium, silicon, manganese, zirconium, cerium, ytrrium, magnesium, cobalt, hafnium, titanium, or a combination comprising at least one of the foregoing.

7. The corrosion inhibitor composition of claim 1, wherein the at least one capping ligand comprises thiols, alkanethiols, alkyl amines, alkoxylated amines, mercaptoalkyl amines, phosphates, alkyl ether phosphates, alcohols, alkoxylated alcohols, mercaptoalcohols, modified linear aliphatic polymers, alkyl silanes, mercaptoalkyl silanes, alkylphosphine oxides, or a combination comprising at least one of the foregoing.

8. The corrosion inhibitor composition of claim 1, further comprising stabilizers, pH regulators, viscosity modifiers, wetting agents, or a combination comprising at least one of the foregoing.

9. A method for inhibiting corrosion in a combustion engine, comprising:

adding a corrosion inhibitor composition to a fuel, wherein the corrosion inhibitor composition comprises a plurality of nanoparticles formed of an inorganic composition having an average longest dimension of about 1 nanometer to about 100 nanometers and comprising a metal boride, a metal oxycarbide, a metal silicide, or a combination comprising at least one of the foregoing; and a at least one capping ligand bound to at least one nanoparticle, wherein the inorganic composition is insoluble in the fuel;

contacting the corrosion inhibitor composition with a corrosion causing contaminant in the fuel, wherein the corrosion causing contaminant comprises sodium, potassium, lead, vanadium, zinc, mercury, or a combination comprising at least one of the foregoing; and reducing a concentration of the corrosion causing contaminant by reacting the plurality of nanoparticles with the corrosion causing contaminant and forming a higher melting temperature non-corrosive product, wherein the melting temperature is greater than the melting temperature of the corrosion causing contaminant.

10. The method of claim 9, wherein the corrosion inhibitor composition is added to the fuel as a mixture, and wherein the plurality of nanoparticles are disposed in a carrier fluid.

11. The method of claim 10, wherein the at least one capping ligand comprises a binding group and a tail group, wherein the tail group is configured to interact with the carrier fluid and/or the fuel.

12. The method of claim 9, wherein the inorganic composition is present in the fuel at a concentration of about 1 part per million to about 5000 parts per million.

13. The method of claim 9, wherein adding the corrosion inhibitor to the fuel comprises forming the inorganic active component by a process selected from the group consisting of sol-gel processing, gas phase synthesis, sonochemical processing, hydrodynamic cavitation, microemulsion processing, high-energy mechanical attrition, or a combination comprising at least one of the foregoing.

14. The method of claim 9, wherein the plurality of capping ligands comprises thiols, alkanethiols, alkyl amines, alkoxylated amines, mercaptoalkyl amines, phosphates, alkyl ether phosphates, alcohols, alkoxylated alcohols, mercaptoalcohols, modified linear aliphatic polymers, alkyl silanes, mercaptoalkyl silanes, alkylphosphine oxides, or a combination comprising at least one of the foregoing.

15. The method of claim 9, wherein the fuel comprises natural gas, methane, naphtha, butane, propane, diesel, kerosene, an aviation fuel, a coal-derived fuel, a bio-fuel, an oxygenated hydrocarbon feedstock, or combination comprising at least one of the foregoing fuels.

* * * * *